US006363768B1

(12) United States Patent
Earls et al.

(10) Patent No.: US 6,363,768 B1
(45) Date of Patent: Apr. 2, 2002

(54) PRECISION BUCKING BAR

(75) Inventors: Jack B. Earls, Sand Springs; Charles C. Bland, II, Claremore, both of OK (US)

(73) Assignee: Aviation Tools & Technologies International, L.L.C., Tülsa, OK (US)

( * ) Notice: Subject to any disclaimer, the term of this patent is extended or adjusted under 35 U.S.C. 154(b) by 0 days.

(21) Appl. No.: 09/597,518

(22) Filed: Jun. 20, 2000

(51) Int. Cl.[7] ..... B21J 15/40
(52) U.S. Cl. ..... 72/476; 72/476; 29/243.53
(58) Field of Search ..... 72/476, 479; 29/243.53

(56) References Cited

U.S. PATENT DOCUMENTS

| | | | | | |
|---|---|---|---|---|---|
| 304,505 | A | * | 9/1884 | Clinch | 72/479 |
| 1,380,984 | A | * | 6/1921 | Lenhart | 72/479 |
| 1,414,095 | A | * | 4/1922 | Power | 72/479 |
| 2,070,309 | A | * | 2/1937 | Osborne | 72/476 |
| 2,353,559 | A | | 7/1944 | Hajek, Jr. | |
| 2,354,914 | A | | 8/1944 | Goldstein | |
| 2,512,532 | A | | 6/1950 | Sargent et al. | |
| 3,585,838 | A | | 6/1971 | Newton | |
| 3,898,835 | A | | 8/1975 | Winter et al. | |
| 4,218,911 | A | | 8/1980 | Johnston | |
| 4,630,463 | A | | 12/1986 | Knowlton | |
| 4,649,733 | A | | 3/1987 | Gilmore | |
| 5,557,835 | A | * | 9/1996 | Brandts | 72/479 |
| 5,953,952 | A | | 9/1999 | Strickland | |

* cited by examiner

*Primary Examiner*—David Jones
(74) *Attorney, Agent, or Firm*—Fellers, Snider, Blankenship, Bailey & Tippens, P.C.

(57) ABSTRACT

A precision bucking bar comprising a unitary rigid structure having a bucking surface thereon and a sidewall extending from the bucking surface such that, during a spreading operation, the bucking surface cannot contact the workpiece, thus producing a square butt of uniform thickness and a method for using the same. In another embodiment, the bucking surface is incorporated into a squeeze point for squeezers.

3 Claims, 2 Drawing Sheets

PRECISION BUCKING BAR

BACKGROUND OF THE INVENTION

1. Field of the Invention

This invention relates generally to a method and apparatus for spreading rivets. More particularly, but not by way of limitation, the present invention relates to a precision bucking bar which controls the shape and the thickness of the butt of a rivet as it is spread to improve the quality of the riveting operation.

2. Background

Riveting is a common method for fastening sheet metal. In a typical riveting operation, a hole is drilled through multiple layers of sheet metal to be joined, a rivet of appropriate diameter and length is inserted through the hole, then the shank end of the rivet is spread so that the rivet is retained in the hole by its head on one side of the joint and by the spread shank, or butt, on the other side of the joint. Numerous methods are available for spreading rivets but primarily, squeezes are used where access permits, and a riveter, or driver, is used in conjunction with a bucking bar where access is not appropriate for using squeezes.

A bucking bar is basically a metal anvil which is placed against the end of the shank of a rivet. Typically, a flat surface of the bucking bar interfaces a flat end of a rivet shank. The head of the rivet is then "hammered" by a driver, thereby causing the shank to spread against the bucking bar. To produce a properly shaped butt of proper thickness, prior art bucking bars have required a skilled operator. Failure of the operator to hold the bucking bar square against the rivet shank will result in misshaped butts and bad rivet resulting in costly rework. Furthermore, prior art bucking bars are prone to wandering during the spreading operation and occasionally wander off the shank, likewise resulting in a bad rivets and subsequent rework.

Bucking bars are available in a variety of shapes and sizes to accommodate various obstacles which potentially interfere with a spreading operation.

Previous attempts have been made to develop a precision bucking bar which will produce a consistent butt regardless of operator skill. Such bucking devices suffer from a number of limitations. For example, they have universally required a relative large space behind the rivet, a luxury not available in many installations; they have not been available in a variety of geometries to avoid nearby obstacles; and they have not been of a conventional shape or size and thus have not felt familiar to an experienced operator. Hence, prior art precision bucking bars have not been well received in the field.

A second method for spreading a rivet employs an apparatus commonly known as "squeezes." Squeezes typically include a pair of removable anvils, or points, a first point shaped to receive a rivet head, and a second provides a flat surface to interface the flat end of a rivet shank. To spread a rivet with a pair of squeezes, the rivet must be close enough to the edge of the workpiece for the squeezes to reach the rivet. The rivet is placed in a hole through multiple layers of sheet metal to be joined, the anvils are placed against each end of the rivet, and the operator squeezes the handle together to produce a compressive force between the head of the rivet and the end of the shank, thereby causing the rivet to spread. Automatic squeezes are also available wherein the points are pressed towards each other by a pneumatic or hydraulic actuator. As with driving a rivet, producing a quality butt requires the operator to maintain a consistently square angle between the face of the flat anvil and the rivet shank. Producing a consistent, quality butt requires an experienced operator.

Common to either type of spreading operation, a properly shaped butt of consistent thickness is essential to achieving maximum strength of the riveted joint. An improperly shaped butt may be too weak to hold under expected stresses or may concentrate stress in a small area resulting in failure of the workpiece.

It is thus an object of the current invention to provide a precision bucking bar which will consistently spread a rivet to form a butt of uniform thickness, regardless of operator skill level, and which may be produced in traditional shapes and sizes to accommodate rivets in a variety of installations and to provide a "natural" feel to an experienced operator.

It is a further object of the present invention to provide squeeze points which will produce a properly shaped rivet butt of consistent thickness and shape regardless of operator skill level.

SUMMARY OF THE INVENTION

These and other objects and advantages are achieved in a precision bucking bar whereon is provided one or more slots of a precise depth to produce a rivet butt of consistent shape and consistent thickness regardless of the skill level of the operator. By controlling the shape and thickness of the butt, a rivet may consistently be spread within engineering specifications, thereby ensuring each rivet will perform as intended and not transfer applied stresses to adjoining rivets.

In contrast to conventional bucking bars which provide only a flat surface, the degree to which the precision bucking bar can "wander" during the spreading operation is limited by the edges of the slot produced thereon.

The inventive device is of a conventional shape and size to appeal to the experienced operator, to eliminate any need to retrain, and to allow use in any installation where a conventional bucking bar may be used.

In another embodiment, there is provided squeeze points for conventional squeezes which include, on the shank point, a slot or dimple of precise shape, depth and size to properly shape the butt of a rivet during the spreading operation.

A better understanding of the present invention, its several aspects, and its objects and advantages will become apparent to those skilled in the art from the following detailed description, taken in conjunction with the attached drawings, wherein there is shown and described the preferred embodiment of the invention, simply by way of illustration of the best mode contemplated for carrying out the invention.

DETAILED DESCRIPTION OF THE PREFERRED EMBODIMENT

Before explaining the present invention in detail, it is important to understand that the invention is not limited in its application to the details of the construction illustrated and the steps described herein. The invention is capable of other embodiments and of being practiced or carried out in a variety of ways. It is to be understood that the phraseology and terminology employed herein is for the purpose of description and not of limitation. While the following discussion is directed toward instruction for performing physical training, the invention is not limited to this particular application.

Figure 2:
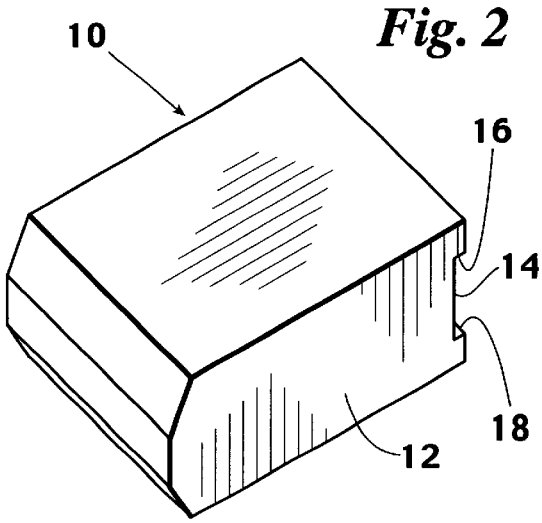
FIG. 2 provides an elevational view of the inventive precision bucking bar.
Figure 3:
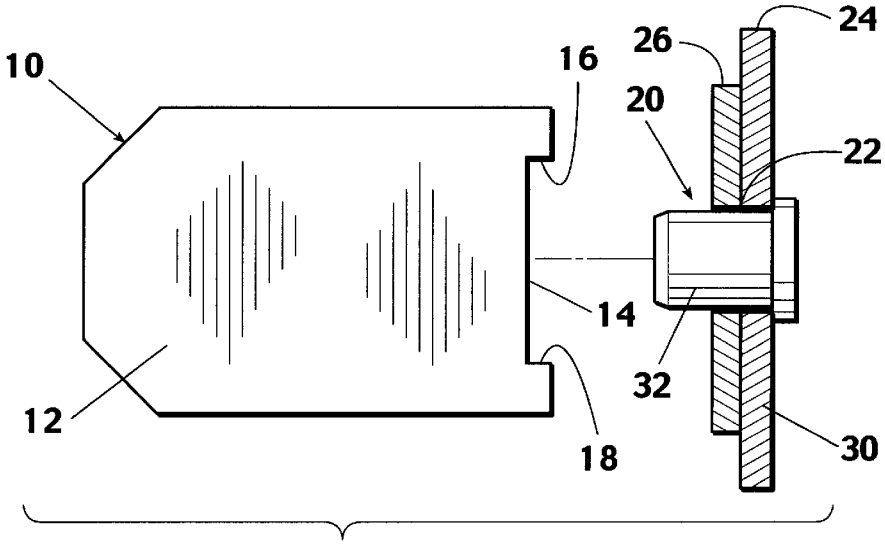
FIG. 3 provides a side view of the inventive precision bucking bar prior to a spreading operation.
Figure 4:
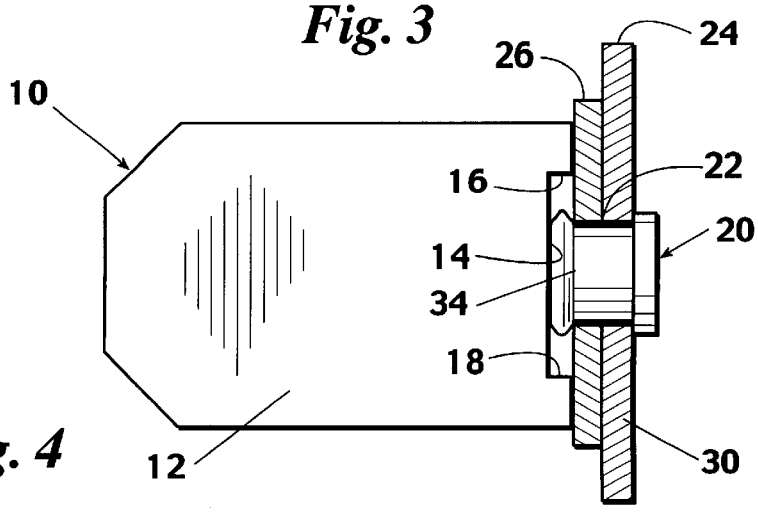
FIG. 4 provides a side view of the inventive precision bucking bar after a spreading operation.

The invention provides a method and apparatus for spreading a rivet, having application in the fastening of sheet metal in diverse fields such as aviation, construction, and fabrication. In a first embodiment of the inventive precision bucking bar 10 as shown in FIGS. 2, 3, and 4, the inventive apparatus comprises a unitary rigid structure 12, having at least one bucking surface 14 thereon. As used herein, a bucking surface is a flat, hard surface intended to squarely interface the shank end of a rivet during a spreading operation. The bucking surface of the inventive device has first side wall 16 and second side wall 18 such that the bucking surface resembles a slot located at one end of the bucking bar 10.

Referring to FIGS. 3 and 4, in operation, the bucking surface 14 is placed against the shank end of rivet 20 placed through a hole 22 which has been formed through multiple layers of sheet metal 24 and 26, collectively referred to herein as the workpiece 30, such that the head 28 of rivet 20 is in contact with the workpiece 30. As the rivet is driven, the shank 32 spreads to form butt 34, thereby fastening the various layers of workpiece 30 together. Once side walls 16 and 18 contact the workpiece 30, no further spreading of the rivet 20 is possible. As will be obvious to those skilled in the art, the thickness of butt 34 will be determined by the height of side walls 16 and 18. Thus, a square butt of uniform thickness will be consistently formed when using precision bucking bar 10.

Figure 5:
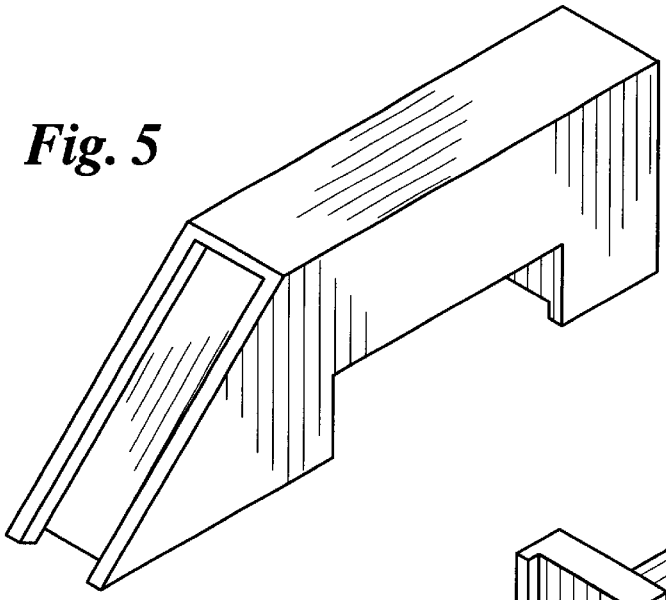
FIG. 5 provides an elevational view of another preferred embodiment of the inventive precision bucking bar.
Figure 6:
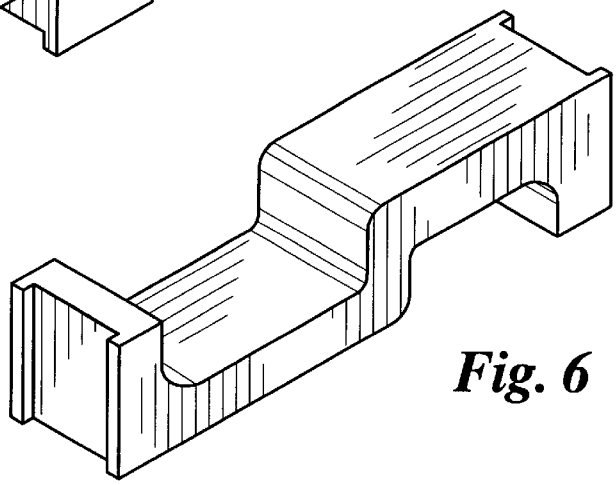
FIG. 6 provides an elevational view of a preferred embodiment of the inventive precision bucking bar having two bucking surfaces thereon.
Figure 8:
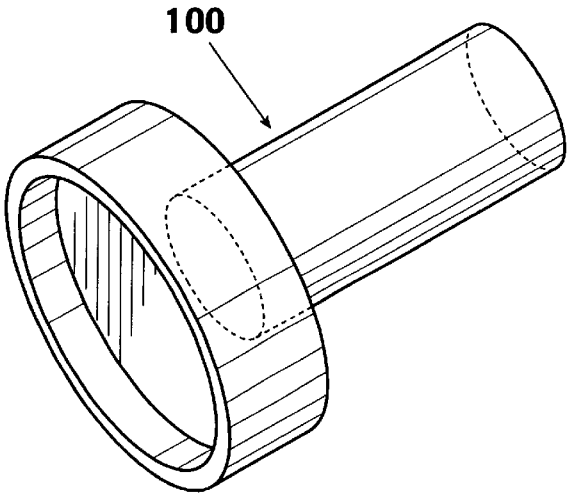
FIGS. 7 and 8 provide elevational views of a pair of inventive precision squeeze points.

While the inventive bucking bar has thus far been discussed with reference to the shape shown in FIGS. 2, 3, and 4, the invention is not so limited. Traditionally, bucking bars have been available in a variety of shapes and sizes to accommodate limited spaces on one side of the workpiece or to avoid obstacles located near the rivet. The present invention may likewise be embodied in virtually any shape or size. For example FIGS. 5 and 6 depict alternate embodiments of the inventive device in traditional shapes which have been widely available for conventional bucking bars. It should be noted that FIG. 6 depicts an embodiment of the inventive precision bucking bar whereon are provided multiple bucking surfaces.

Figure 1:
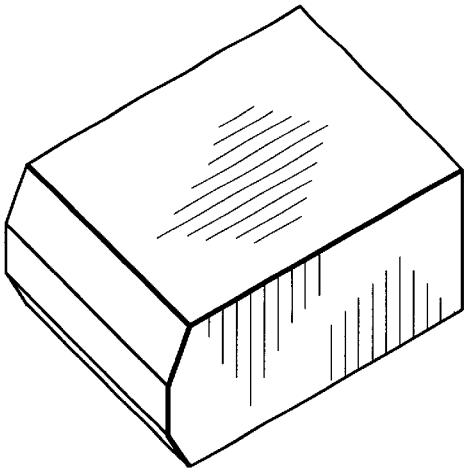
FIG. 1 provides an elevational view of a prior art bucking bar.

Referring next to FIG. 1, wherein is shown a prior art bucking bar, it should be noted that a conventional bucking bar provides a bucking surface without sidewalls. It has been common for a conventional bucking bar to wander in relation to the end of the rivet shank due to vibration created during the riveting operation. Occasionally, this results in the bucking bar slipping off of the rivet resulting in misshaped butts and costly rework. As shown in FIGS. 3 and 4, side walls 16 and 18 of the inventive device limit the movement of bucking bar 10 in at least two directions, dramatically improving the operator's ability to control the device, thereby reducing the tendency to wander and the associated risks of damage.

While the inventive device has been described hereinbefore as incorporating side walls such that the bucking surface resembles a slot, the invention is not so limited. For example, the bucking surface could be circular with a cylindrical side wall, or additional side walls could be located adjacent the bucking surface to fully enclose the same.

Figure 7:
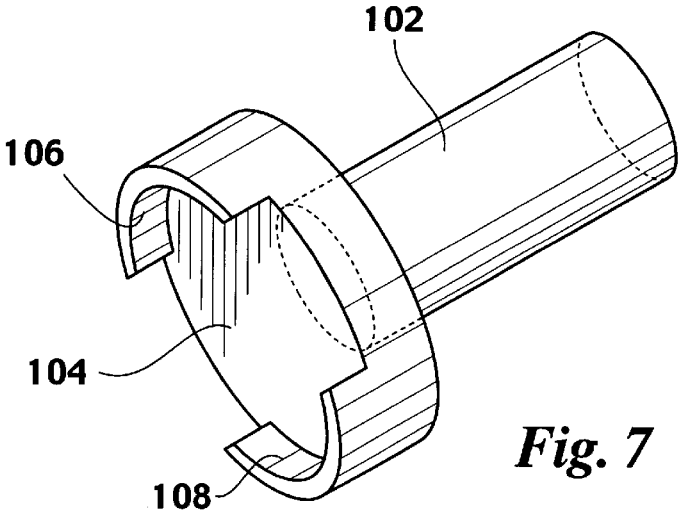

An alternate embodiment 100 of the inventive device is shown in FIG. 7 wherein is shown a pair of squeeze points. Squeeze points are anvils which are removably attached to squeezes, either plier like devices or automatic devices for spreading a rivet. The inventive squeeze point 102 includes bucking surface 104 located between side walls 106 and 108. As with the previously discussed bucking bar, the thickness of the butt created during the squeeze operation is determined by the height of side walls 106 and 108. Once side walls 106 and 108 contact the workpiece, no further spreading may take place. Thus, the inventive squeeze points will result in a consistently square butt of uniform thickness.

What is claimed is:

1. A precision bucking bar for spreading a rivet through a workpiece comprising:

a solid unitary structure having at least a first bucking surface thereon, said bucking surface having a first side wall, wherein said first side wall extends outwardly from said first bucking surface such that, when a rivet is spread, said first side wall will prevent said first bucking surface from contacting the workpiece.

2. The precision bucking bar of claim 1 wherein said unitary structure includes:

a second bucking surface, said second bucking surface having a second side wall, wherein said second side wall extends outwardly from said second bucking surface such that, when a rivet is spread against said second bucking surface, said second side wall will prevent said second bucking surface from contacting the workpiece.

3. A method for spreading a rivet having a head and a shank end using the apparatus of claim 1 including the steps of:

(a) forming a hole through the workpiece;

(b) placing a rivet through said hole;

(c) placing a driver on the head of the rivet;

(d) placing said bucking surface against the shank end of said rivet;

(e) operating said driver until said side wall contacts the workpiece.

* * * * *